United States Patent [19]

Fromman

[11] 4,196,714

[45] Apr. 8, 1980

[54] FIREBOX WITH MOVABLE HOOD OR HOOD SECTIONS

[76] Inventor: Arthur R. A. Fromman, 4517 N. 17th Dr., Phoenix, Ariz. 85015

[21] Appl. No.: 3,897

[22] Filed: Jan. 16, 1979

Related U.S. Application Data

[60] Continuation-in-part of Ser. No. 672,663, Apr. 1, 1976, abandoned, Division of Ser. No. 795,759, May 11, 1977, Pat. No. 4,138,987.

[51] Int. Cl.[2] ..... F24B 1/18

[52] U.S. Cl. ..... 126/120; 126/125; 126/307 R; 126/58

[58] Field of Search ..... 126/120, 125, 307, 58, 126/64, 62, 65; D23/95, 96, 97; 98/115 VM

[56] References Cited

U.S. PATENT DOCUMENTS

| | | | |
|---|---|---|---|
| 984,598 | 2/1911 | Pendray | 126/125 |
| 1,467,815 | 9/1923 | Roemer | 126/58 X |
| 2,122,635 | 7/1938 | Borgstrom | 126/125 |
| 3,602,128 | 8/1971 | Lindkvist | 98/115 VM |
| 4,026,200 | 5/1977 | Lindqvist | 98/115 VM |
| 4,086,847 | 5/1978 | Overmyer | 98/115 VM |

FOREIGN PATENT DOCUMENTS

| | | | |
|---|---|---|---|
| 23285 | 12/1882 | Fed. Rep. of Germany | 126/120 |

*Primary Examiner*—James C. Yeung
*Assistant Examiner*—Larry Jones
*Attorney, Agent, or Firm*—Warren F. B. Lindsley

[57] ABSTRACT

A firebox having a hood or hood sections movable along or about a given line or point respectively on its hearth for positioning its opening in any one of a number of different positions.

3 Claims, 17 Drawing Figures

FIREBOX WITH MOVABLE HOOD OR HOOD SECTIONS

BACKGROUND OF THE INVENTION

This application is a continuation in part of application Ser. No. 672,663 filed Apr. 1, 1976 entitled Firebox With Movable Hood or Hood Sections now abandoned as well as a divisional application of Ser. No. 795,759 filed May 11, 1977 and entitled Firebox with Movable Hood or Hood Sections now U.S. Pat. No. 4,138,987 2/13/79.

This invention relates to fireboxes and more particularly to stoves, furnaces, fireboxes and hooded fireplaces mounted on a hearth or fire brick platform.

With conventional brick or stone fireplaces the opening of the fireplace is fixed at the time of construction and many of them have been primarily decorative and often times inefficient as a heat producing unit since their openings may not face the area of the room desired at any paticular time.

DESCRIPTION OF THE PRIOR ART

Improvements embracing heat shields, fireplace screens and hoods have been covered by patents but none have been directed to removable or revolvable hoods or combination hood and firepan constructions in order to direct its opening to a number of positions around or along a given line, arc or circle, thereby making it more efficient as a heater for a given area of a room or more effective as a decorative feature of more than one furniture arrangement in the room.

U.S. Pat. Nos. 3,220,400; 3,339,540; 3,359,968 and 3,515,122 are examples of the prior art which are directed to recent fireplace improvements.

Generally, prior art fireplaces have been improved from an ornamental point of view assembled to form a variety of shapes.

SUMMARY OF THE INVENTION

In accordance with the invention claimed, a new and improved hood or hood sections for a stove, furnace, firebox or fireplace is provided which may be moved about its hearth alone or in combination with its firepan to selectively direct its opening at any point along its path without disturbing the hearth or chimney structure.

It is, therefore, one object of this invention to provide a new and improved hood for a stove, furnace, firebox or fireplace.

Another object of this invention is to provide an improved hood or hood sections for a stove or fireplace which is movable on its hearth in combinations with its firepan.

A further object of this invention is to provide an improved fireplace, the hood of which may be selectively moved on its hearth to position the opening in the hood at any of a number of positions.

A still further object of this invention is to provide a fireplace or stove which may be mounted at a given place in a room and selectively positioned to face any direction or area at will.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompaying drawing in which.

DESCRIPTION OF THE PREFERRED EMBODIMENT

Figure 1:
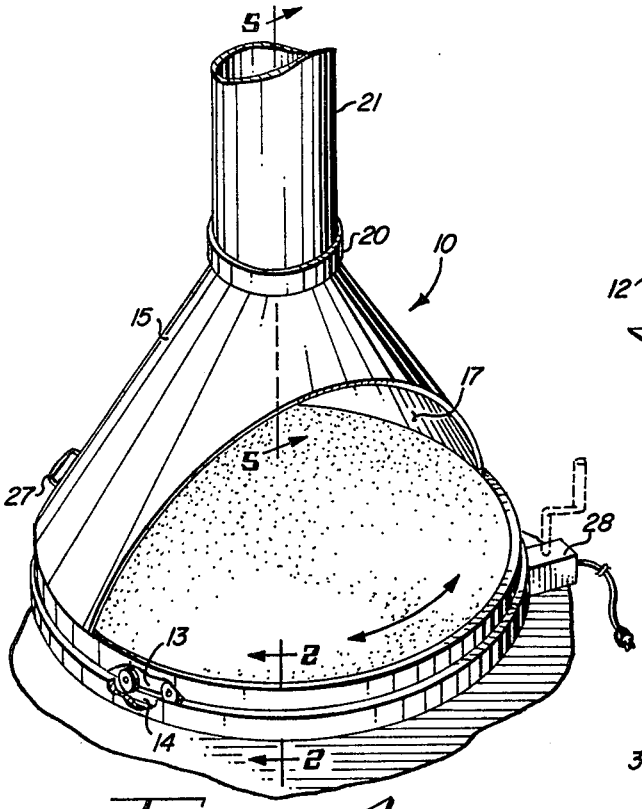
FIG. 1 is a perspective view of a fireplace embodying the invention.
Figure 2:
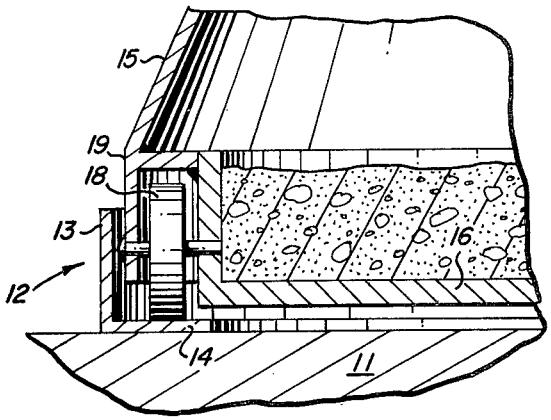
FIG. 2 is a cross-sectional view of FIG. 1 taken along the line 2—2.
Figure 5:
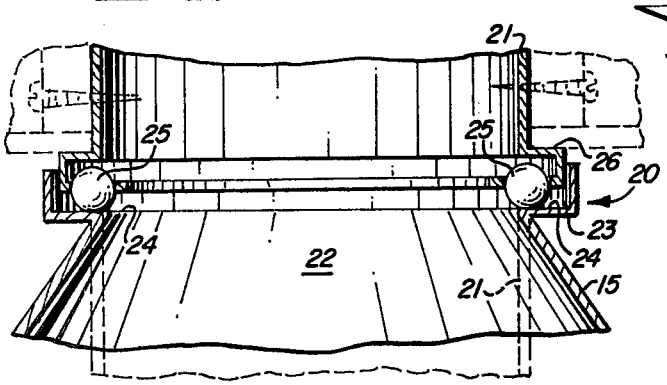
FIG. 5 is a cross-sectional view of FIG. 1 taken along the line 5—5.

Referring more particularly to the drawing by characters of reference, FIGS. 1, 2, and 5 disclose a stove or fireplace 10 supported on any suitable hearth 11. As shown, the hearth is provided with a path or track 12 on its upper surface around its periphery having one leg 13 extending laterally therefrom as a guard for a wheel means and another leg 14 arranged to lie on the surface of the hearth. A shield or hood 15 having a cone-shaped configuration is fixedly attached to a firepan 16 extending below the hood. The hood and firepan are movably or revolvably mounted on the hearth so that an opening 17 in the hood, which may be screen-covered or not, is faced in any direction linearly or around a circle of rotation or part thereof on hearth 11.

FIG. 2 illustrates one way of rotatively mounting the hood and comprises a plurality of wheel means 18 spacedly arranged around the periphery of the hood and firepan and joined between a flange 19 extending laterally of the hood and the periphery of the firepan. The wheel means are arranged to rotate over track 12 as shown in FIG. 2.

Although a generally cone-shaped hood configuration is shown, any desirable shape may be used and fall within the concept of this invention providing the hood is movable along or around any given line or point, respectively, on its hearth.

As shown, hood 15 meets the hearth around approximately half of its perimeter to define rear and side walls of the fireplace. The tapered hood is spaced from the hearth around approximately the other half of the perimeter thereof to define the fireplace opening. At the upper end of the hood it terminates in a flue collar 20 for association with a suitable flue 21.

FIG. 5 illustrates one way of associating in a rotative manner the hood of a fireplace to its flue. In FIG. 5, flue collar 20 is provided with a reduced diameter first end portion 21 which extends into the small opening 22 of the hood and a larger diameter second end portion 23 which form a race or track 24 for a plurality of ball bearings 25 spacedly mounted in a collar 26 in the juxtapositioned end of the flue.

Thus, when hood 15 of the fireplace is moved it rotates around a given path on the hearth and around collar 26 of the flue. It should be noted that collar 20 may be fixedly attached to flue 21 at its lower end and then the hood and a portion of the flue may be provided with interlocking collars similar to collars 20 and 26 at a point spaced from the hood such as adjacent to the ceiling of the room in which the fireplace is assembled.

In order to aid in rotating the hood on its hearth an insulated handle 27 may be mounted on the outer surface of the hood at any suitable position. Further, a hand or motor driven gear arrangement 28 may be used to rotate the hood if more force is needed.

Figure 3:
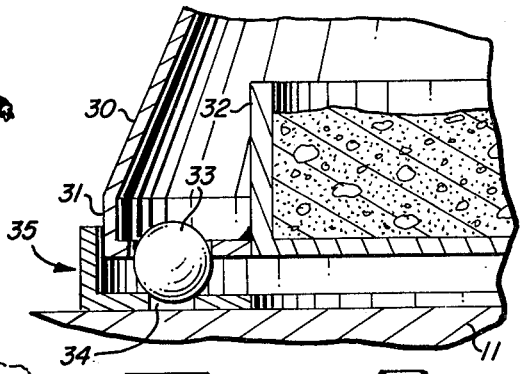
FIG. 3 is a partial cross-sectional view of a modification of the structure shown in FIGS. 1 and 2 showing a ball bearing rotating means of the hood.

FIG. 3 is a modification of the hood and firepan shown in FIGS. 1 and 2 wherein a conical-shaped hood 30 for a fireplace is formed between its outer edge 31 and firepan 32 to hold a plurality of ball bearings 33 which are spacedly positioned around the inside peripheral surface of the hood. The ball bearings are arranged to follow a race or track 34 formed in the flat surface of a guide 35 mounted on hearth 11.

Figure 4:
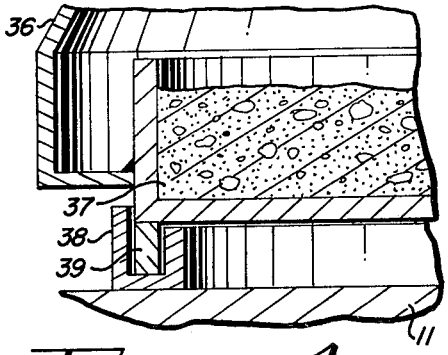
FIG. 4 is a partial cross-sectional view of a further modification of the hood and fireplace rotating means shown in FIGS. 1–3.

FIG. 4 illustrates a further modification of the fireplace structure shown in FIGS. 1–3 wherein hood 36 is fixedly attached to firepan 37, as shown, both of which are revolvably mounted on hearth 11.

To aid in maintaining hood 36 and firepan 37 in a given rotational pattern on the hearth, a U-shaped arcuate track 38 is secured to receive between its legs a flange 39 of the firepan which may be formed of any suitable material which will reduce friction in its sliding movement along the path 38. Such material may be "Teflon", "Orlon" or any other similar material which will withstand heat.

Figure 6:
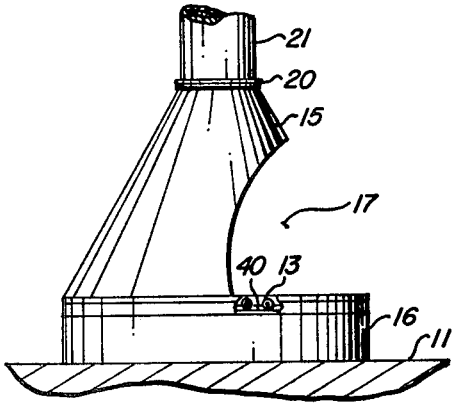
FIG. 6 is a side view of a further modification of the structures shown in FIGS. 1–5 wherein the hood is rotated independently of the firepan.

FIG. 6 illustrates a further modificaton illustrating the hood 15 of FIG. 1 mounted to rotate on whell means 13 about the top peripheral edge 40 of the firepan 16.

Figure 7:
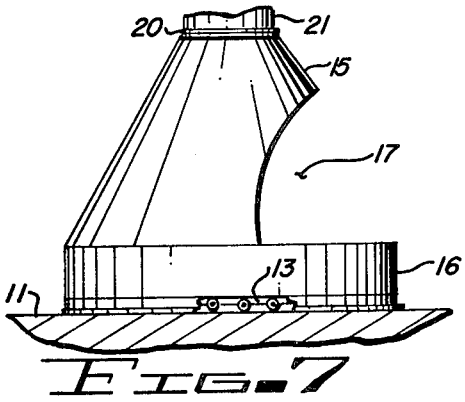
FIG. 7 is a still further modificaion of the fireplace structures shown in FIGS. 1–6 wherein the hood and firepan are mounted on rollers which rotate in a circular track or on a hearth.

FIG. 7 illustrates a still further embodiment of FIGS. 1 and 6 wherein hood 15 and firepan 16 together revolve on wheel means around a given track on hearth 11.

Figure 8:
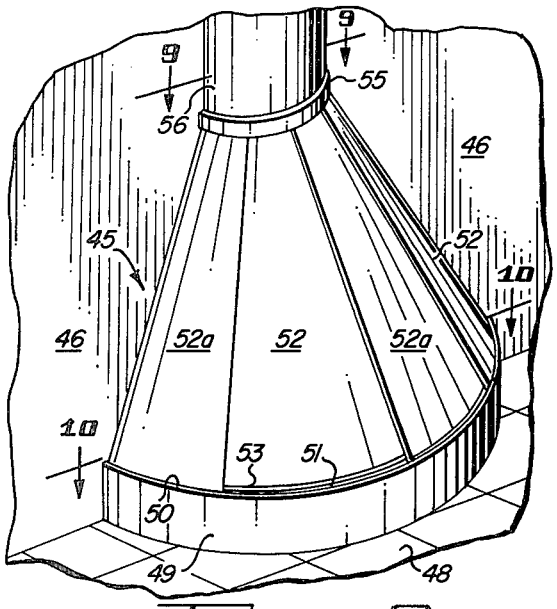
FIG. 8 is a perspective view of a fireplace having openings facing into juxtapositioned rooms and embodying the invention.
Figure 9:
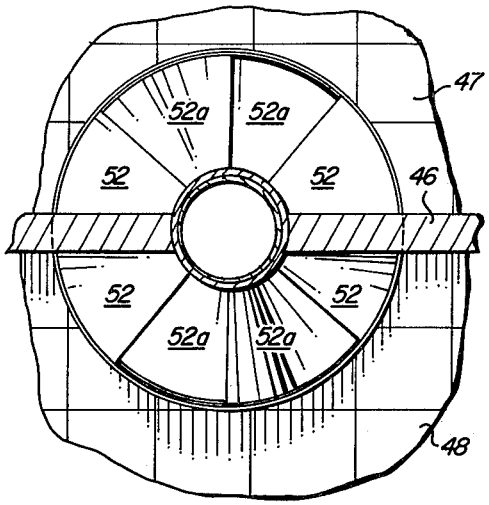
FIG. 9 is a cross-sectional view of FIG. 8 taken along the line 9—9.
Figure 10:
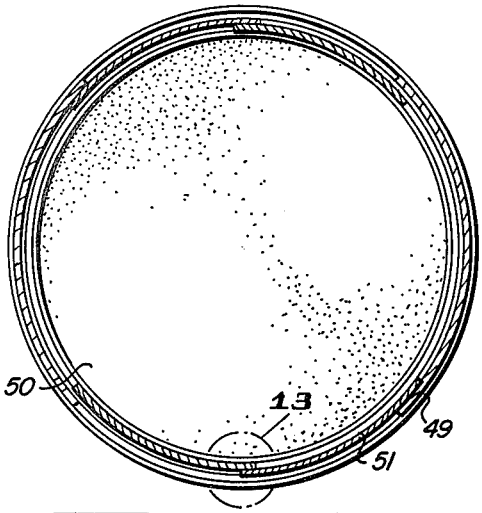
FIG. 10 is a cross-sectional view of FIG. 8 taken along the line 10—10.

FIGS. 8–10 disclose a further modification of the structure shown in FIGS. 1–7 wherein a firebox or fireplace 45 is illustrated which is mounted within a wall 46 separating two juxtapositioned rooms 47 and 48. The structure comprises a hearth 49 having mounted on its upper surface 50 a track means 51. Track means 51 is arranged for receiving and guiding in it the lower tapered-out edges 53 of a plurality of panels 52. The upper edges 54 of the panels 52 are received and guided in an arcuate track means 55 which is similar to track means 51 except that it is mounted around the flue rather than on the hearth.

Figure 13:
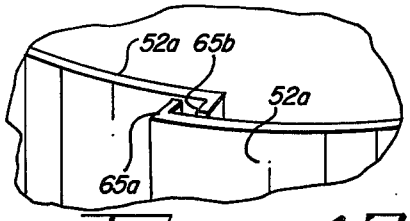
FIG. 13 is an enlarged partial view showing the interlocking means for adjacent panel sections.

As noted from the drawings, at least a number of panels 52 are arranged in a separate track for juxtapositioned panels so that panels 52A may be revolved to partially or fully overlap the adjacent panels 52 thereby increasing or decreasing the opening of the fireplace. Interlocking means 65 are provided on adjacent panels 52A comprising finger-like members 65A and 65B which will engage, interlock and move along a following panel section in its direction of movement, as shown in FIG. 13.

Figure 11:
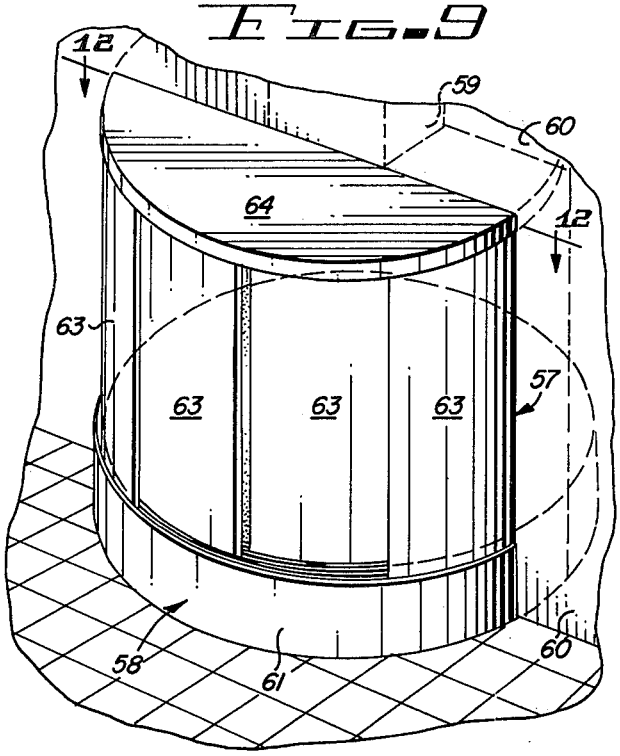
FIG. 11 is a perspective view of a hood section for a fireplace opening into juxtapositioned rooms employing overlapping track mounted hood sections.
Figure 12:
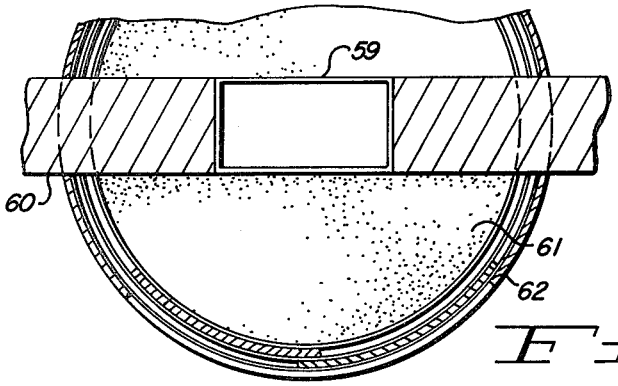
FIG. 12 is a cross-sectional view of FIG. 11 taken along the line 12—12.

FIGS. 11 and 12 illustrate a further modification of the wall-mounted fireplace shown in FIGS. 8–10 wherein a hood section 57 is mounted around the fireplace 58 and flue 59 opening into adjacent rooms separated by wall 60. A hearth 61 is arranged to extend in an arcuate configuration on each side of or through wall 60 such that a plurality of panels 63 forming heat and light shields, screens or radiating sections may move in an overlapping manner to open, close or partially close the entrance to the fireplace.

As shown in FIG. 11, a top plate 64 is mounted over the upper ends of panels 63 and abut against the wall 60 to enclose the section 57.

Figure 14:
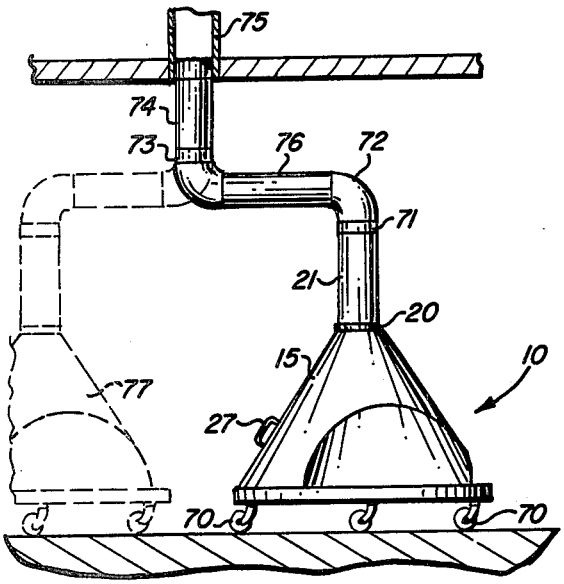
FIG. 14 is a further modificaion of the fireplace shown in FIGS. 1 and 8 wherein the fireplace pivots around two positions on its stack.

FIG. 14 illustrates a further modification of the structures shown in FIGS. 1–13 wherein a fireplace similar to that shown in FIG. 1, the parts of which are identified with the same reference characteres, is mounted on suitable casters 70. With casters 70 utilized on the structure shown in FIG. 1, the fireplace 10 may be revolved around the pivot point 71 of the end portion 21 of the flue with the elbow 72. Further, a collar 73 may be utilized in the flue structure between a flue portion 74 and a chimney 75 which provides a further pivotal connection of the relatively horizontal flue portion 76 and the elbow 72.

With this type of structure, fireplace 10 may be rotated about a given path due to its pivotal connection at collar 20 or point 71 to the flue portions 74 and 76 or around a plurality of different circular paths 77 depending on the relative pivotal position of the fireplace 10 relative to flue portion 74 around its pivot point or collar 73.

Figure 15:
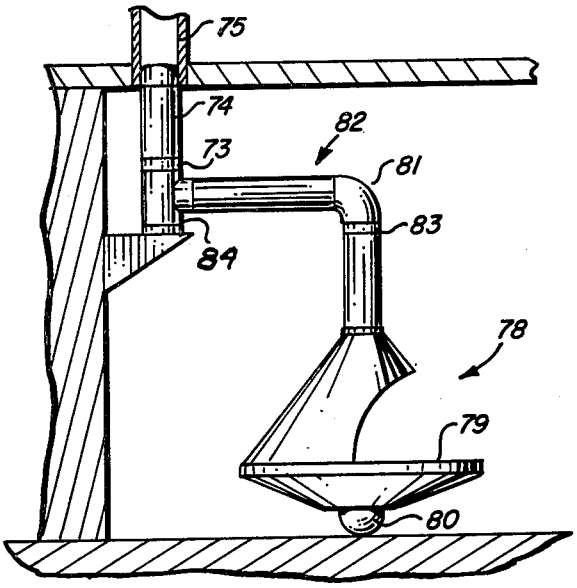
FIG. 15 is a still further modification of the fireplace and stack configuration shown in FIG. 14.

FIG. 15 discloses a further modification of the structure shown in FIGS. 1–14 wherein a fireplace 78 having a suitable firebox 79 arranged therein is mounted on a single suitable caster-type structure 80. This fireplace may be pivotally mounted at its elbow 81 of flue 82 by means of a suitable collar structure 83 and another collar structure 73 at the connecton of the flue 74 to the chimney 75 through a flue connection 84. This structure, in the manner discussed above for the structure shown in FIG. 14, may be moved through a number of arcuate paths at different positions in a room.

Figure 16:
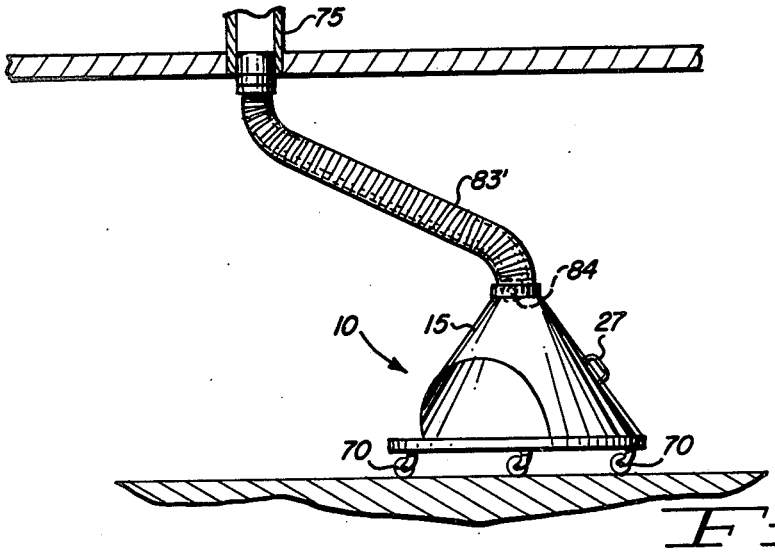
FIG. 16 is a still further modificaton of the fireplace shown in FIG. 14 illustrating a flexible stack.

FIG. 16 discloses a still further modification of the structure shown in FIG. 14 wherein the fireplace 10 shown therein is connected by a suitable flexible and resilient flue structure 83' to the chimney 75. As shown, a fan 84' may be mounted in the flue structure.

Figure 17:
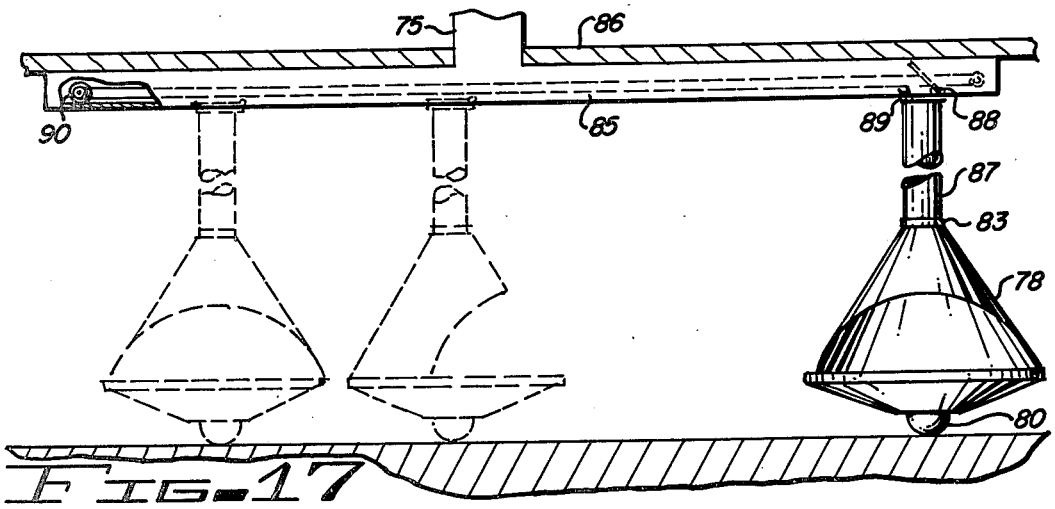
FIG. 17 is a still further modification of the fireplace shown in FIGS. 14–16 wherein the fireplace and stack are movable along a track forming a part of the chimney structure.

FIG. 17 discloses a modification of the mounting or the fireplace 78 shown in FIG. 15 which is movable along a flue portion 85 fixedly mounted on a ceiling 86 which flue portion serves as a track for holding and guiding the movement of the flue portion 87 and fireplace 78 in the manner illustrated. It sould be noted that at particular given inlets 88 to the portion 85 of the flue structure the collar 89 on the flue portion 87 will open up an opening to the flue portion 85 while closing the inlet it previously was connected to when it left that inlet for its new position along flue portion 85. A motor 90 may be used to move the fireplace and flue portion 87 along the track formed by flue portion 85 if so desied.

It should be recognized that the surface over which the fireplace rests must meet any fire code requirements.

Although but a few embodiments of the present invention have been illustrated and described, it will be apparent to those skilled in the art that various changes and modifications beyond those already suggested may be made therein without departing from the spirit of the invention or from the scope of the appended claims.

What is claimed is:

1. A firebox movably supportable on a platform comprising in combination:

a hood means extending from a platform-engaging end toward a flue-engaging end, said hood means comprises at least a pair of panel sections extending between said platform-engaging endand said flue-engaging end which move one relative to the other, caster means attached to said platform-engaging end for engaging and supporting the firebox on the platform for movement thereover, flue means for connecting said flue-engaging end to a fixed chimney structure, and a first swivel means connecting said flue means to said chimney, said flue means comprises a fixed portion mounted on the ceiling of a room and a second portion interconnected to the first portion extending between it and said flue-engaging end of the hood selectively at one of a plurality of points along its length, whereby said firebox may be moved relative to the chimney to a plurality of different positions on the platform.

2. A firebox movably supportable on a platform comprising in combination:

a hood means extending from a platform-engaging end toward a flue-engaging end, caster means attached to said platform-engaging end for engaging and supporting the firebox on the platform for movement thereover, flue means for connecting said flue-engaging end to a fixed chimney structure, a first swivel means connecting said flue means to said chimney, said flue means comprises a fixed portion mounted on the ceiling of a room and a second portion interconnected to the first portion extending between it and said flue-engaging end of the hood selectively at one of a plurality of points along its length, and motorized means for moving the firebox including said flue means and said hood selectively to said plurality of points along said fixed portion of said flue means, whereby said firebox may be moved relative to the chimney to a plurality of different positions on the platform.

3. The firebox set forth in claim 2 wherein: said caster means comprises a single caster.

* * * * *